US007165652B2

(12) United States Patent
Allerding et al.

(10) Patent No.: US 7,165,652 B2
(45) Date of Patent: Jan. 23, 2007

(54) FORK-LIFT TRUCK

(75) Inventors: Uwe Allerding, Ehbsen (DE); Carsten Oestmann, Hamburg (DE); Matthias Duewel, Hamburg (DE)

(73) Assignee: Jungheinrich Aktiengesellschaft, Hamburg (DE)

( * ) Notice: Subject to any disclaimer, the term of this patent is extended or adjusted under 35 U.S.C. 154(b) by 526 days.

(21) Appl. No.: 10/775,421

(22) Filed: Feb. 10, 2004

(65) Prior Publication Data

US 2004/0226776 A1 Nov. 18, 2004

(51) Int. Cl.
*B66B 9/20* (2006.01)

(52) U.S. Cl. ..... 187/224; 414/667

(58) Field of Classification Search ..... 187/224, 187/226, 230, 232–238; 180/233–239, 253, 180/411, 412; 414/662–672
See application file for complete search history.

(56) References Cited

U.S. PATENT DOCUMENTS

| | | | | |
|---|---|---|---|---|
| 5,947,516 | A * | 9/1999 | Ishikawa | 280/755 |
| 6,022,182 | A * | 2/2000 | Everett | 414/544 |
| 6,241,454 | B1 * | 6/2001 | Ruf | 414/667 |
| 6,264,004 | B1 * | 7/2001 | Miyamoto | 187/222 |
| 6,854,556 | B1 * | 2/2005 | Yamamoto et al. | 180/444 |
| 2004/0020724 | A1 * | 2/2004 | Yurushi | 187/224 |
| 2004/0154871 | A1 * | 8/2004 | Allerding et al. | 187/287 |
| 2004/0159499 | A1 * | 8/2004 | Allerding et al. | 187/287 |
| 2005/0133311 | A1 * | 6/2005 | Warner et al. | 187/226 |
| 2006/0169540 | A1 * | 8/2006 | Tygard | 187/222 |

FOREIGN PATENT DOCUMENTS

DE 100 54 789 A1 5/2002

* cited by examiner

*Primary Examiner*—Jonathan Salata
(74) *Attorney, Agent, or Firm*—Vidas, Arrett & Steinkraus, P.A.

(57) ABSTRACT

A fork-lift reach truck having an extraction mast which is adapted to be displaced, by means of a mast drive, towards and away from a driving portion of the fork-lift truck on a horizontal guide, a load-carrying means which is mounted on a side shift, a side shift guide which is supported by the extraction mast in a height-adjustable way and is adapted to be actuated by means of a lifting and lowering drive, which guides the side shift in a laterally movable way, and a side shift drive, and an electric control and regulation device for the respective drives which is connected to operating members for the lifting and lowering modes, the mast extraction mode, and the side shift mode, wherein an analog sensor detecting the position of the side shift is provided the position signal of which is sent to the control and regulation device, and that the control and regulation device is connected to a separate operating member for the side shift or the operating member for the side shift is configured in such a way that actuating it causes the side shift to be automatically moved to a predetermined position.

4 Claims, 1 Drawing Sheet

FORK-LIFT TRUCK

CROSS-REFERENCE TO RELATED APPLICATIONS

Not applicable.

STATEMENT REGARDING FEDERALLY SPONSORED RESEARCH

Not applicable.

BACKGROUND OF THE INVENTION

Like other fork-lift trucks, fork-lift reach trucks comprise a load-carrying portion and a driving portion. The load-carrying portion has a mast which can be composed of several mast sections and which can be extracted to large heights. The feature characteristic of a fork-lift reach truck is that the mast is horizontally movable between a position close to the driving portion and a position remote therefrom. The load-carrying means commonly is a fork where the fork prongs are located within parallel-spaced wheel arms which are mounted on the driving portion and extend away from the driving portion on the two sides of the mast. Such fork-lift reach trucks also have an integrated side shift in many case. The load-carrying means, e.g. the fork, has its back fixed to a slider here which can be moved horizontally on an slider guide. The guide is guided on the mast and can be lifted and lowered by means of the lifting and lowering device. Such a fork-lift reach truck allows to orient the pallet in the rack precisely and quickly with no need for the fork-lift truck to change its position.

It must be sure for a fork-lift reach truck having a side shift that no collision occurs with the wheel arms when the side shift is actuated and the load-carrying means is lowered. The mast with the load-carrying means can be retracted between the wheel arms only when the side shift is in its middle position. It is only in this position of the side shift that the load-carrying means can be lowered between the wheel arms with the lift frame incompletely advanced to the front.

It is known to detect a displacement of the side shift digitally. A hydraulic interlocking is effected which prevents the load-carrying means from being lowered and the mast from being pushed back. The driver initially has to bring the side shift to the middle position before the functions mentioned can be carried out. The disadvantage is that the driver is required to detect the position of the side shift visually and, then, to initiate the sideward shift motion manually to the correct direction via control elements in order to achieve freedom of motion. Besides, the side shift operation has to be completed upon getting at the middle position, for which purpose the driver monitors a relevant display.

DE 100 54 789 A1 has made known an industrial truck in which a side shift is also provided for the load-carrying means. The driving mechanism for the side shift is acted on, depending on operating parameters. This enables it to vary the acceleration and/or speed of the side shift in a nearly infinite way. Such a way avoids elastic deformations and vibrations.

It is the object of the invention to provide a fork-lift reach truck having a side shift the operation of which is simplified and becomes faster.

BRIEF SUMMARY OF THE INVENTION

The invention provides for an analog sensor detecting the position of the side shift the position signal of which is sent to the control and regulation device. The control and regulation device controls all of the regulation procedures in connection with the load-carrying means and the extraction mast in response to an actuation by appropriate handles or operating members in the cabin of the fork-lift reach truck. In addition, the invention provides a specific operating member for the side shift which, when actuated, causes the side shift to automatically move to a predetermined position, or a design of the usual operating member for the side shift which is such that a certain actuation mode causes it to move to the predetermined position in an automatic way. The predetermined position will mostly be the middle position. However, any other position may also be predetermined.

The signal of the analog sensor helps to let the control and regulation device know on which of the two possible sides the side shift is. Moreover, the signal makes possible the automatic movement to the desired position because the position signal of the side shift is also an actual-value signal for the control and regulation device, by which fact the drive for the side shift is stopped when the regular deviation is zero. Therefore, the driver can initially operate the operating member at the start of a lowering operation or retraction of the mast to make sure that the side shift is in the desired position and, hence, in order to exclude any collision with the wheel arms.

As was mentioned, since it is possible to detect the respective position of the side shift a set point transmitter for the side shift drive, in response to its displacement path or angle, can emit a set point signal which is sent to the regulation device to move the side shift to a predetermined position. Thus, this allows to set the side shift to any position, e.g. to pick up a load in the predetermined position.

In an aspect of the invention, in lieu of or in addition to the automatic movement to the predetermined position or middle position of the side shift, it is imaginable that the drive for the side shift initially moves to the middle position if the side shift should be in a position out of the middle when a lowering operation of the load-carrying means or a retraction of the mast is initiated via the relevant operating members. This is the way the movement to the middle position of the side shift can be initiated automatically, e.g. after the retraction of the mast and the manual initiation of the lowering operation. The driver can then dispense with the operation which would otherwise be required before the next fork-lift truck cycle.

Finally, it is imaginable to make the analog information of the side shift sensor be integrated into the positional safety consideration of an onboard computer. Fork-lift reach trucks of the aforementioned type frequently have installed therein an onboard computer which, amongst others, considers various parameters in a travel mode, for example, to modify the traveling speed depending on the height of the load, inclination of the mast, extraction length of the mast, etc. to prevent the occurrence of unstable travelling conditions. The lateral position of a side shift can also lead to an unstable condition. Thus, while calculating the positional safety, the onboard computer can take into account the position of the side shift.

The invention will be described in more detail below with reference to an embodiment shown in the drawings.

DETAILED DESCRIPTION OF THE INVENTION

Figure 1:
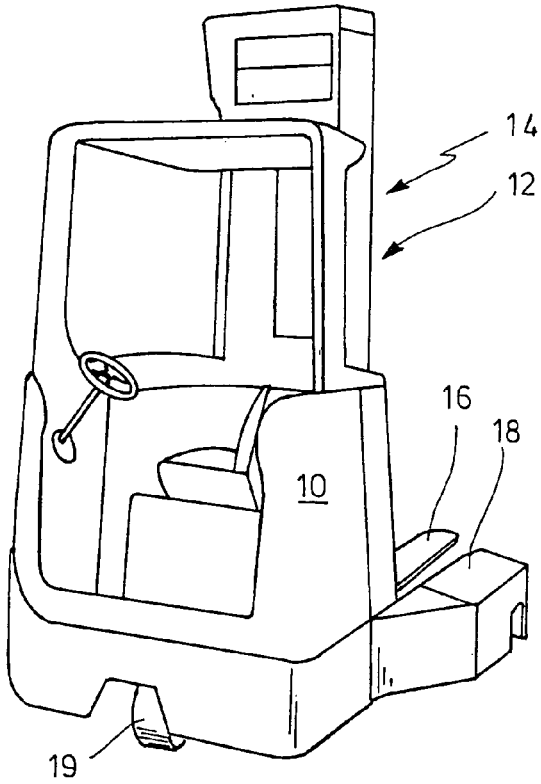
FIG. 1 schematically shows a fork-lift reach truck in a perspective view.

While this invention may be embodied in many different forms, there are described in detail herein a specific preferred embodiment of the invention. This description is an exemplification of the principles of the invention and is not intended to limit the invention to the particular embodiment illustrated The fork-lift reach truck shown in FIG. 1 is of a conventional construction and has a driving portion 10 and a load-carrying portion 12. The load-carrying portion 12 has a mast 14 which has a plurality of mast sections and can be extracted to a height of 12 m or higher, for example. The load-carrying portion 12 also has a load-carrying means which is guided in a height-adjustable fashion on the mast . In FIG. 1, merely a prong 16 of a fork can be seen which is mounted on a carriage which is not shown and, in turn, is horizontally displaceable. The guide required for this purpose is mounted in a height-adjustable fashion on the mast 14 as is known as such for fork-lift trucks. The driving portion 10 has mounted thereon wheel arms which extend at a parallel distance on either side of the mast 14. One wheel arm can be seen at 18 in FIG. 1. The wheel arms support load-carrying wheels each. A steerable driving wheel can be seen at 19.

The mast 14 is horizontally movable away from and towards the driving portion 10 by means of a guide which is not shown in detail. To this end, an operating member, which is not shown, is provided in the cabin of the driving portion 10 to drive the mast extraction. Further, there is an operating member in the cabin for the lifting and lowering mode of the load-carrying fork and the mast. In addition, the mast 14 is also variable in its inclination by means of an appropriate inclination drive with the inclination drive, in turn, being adapted to be actuated via a separate operating member. Finally, there is also an operating member or switching button in the cabin to actuate the side shift.

Figure 2:
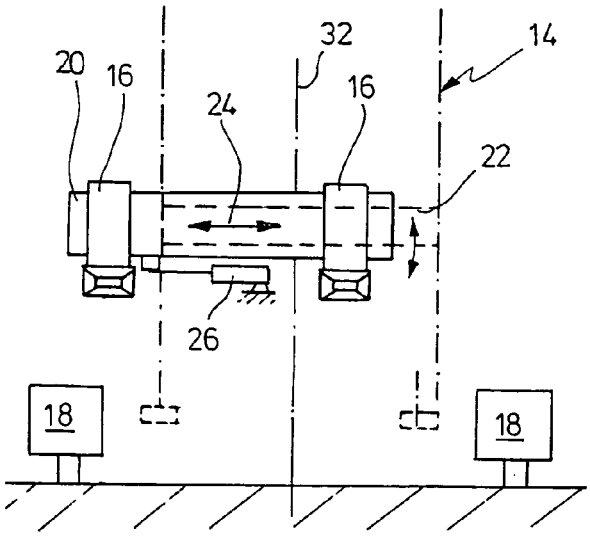
FIG. 2 very schematically shows components of the fork-lift reach truck of FIG. 1 in a front view.

FIG. 2 allows to see the wheel arms 18 and a side shift 20 which is horizontally displaceable along a guide 22 as is indicated by the two-sided arrow 24.

The guide 22 is connected to the lifting and lowering means on the mast 14 which are outlined in a dash-and-dot line in FIG. 2. The side shift has mounted thereon the fork prongs 16. The side shift 20 is engaged by a displacing cylinder 26 to displace it sidewards as is shown by the two-sided arrow 24. For example, an electric drive may be provided instead of the displacing cylinder.

As can be seen from FIG. 2 the load-carrying means can be lowered only when the side shift 20 is in its middle position. In the middle position, the fork prongs 16 are in the middle between the wheel arms 18 as is outlined in a dashed line in FIG. 2. Therefore, when the mast 14 is retracted in between the wheel arms 18 or when the side shift 20 is lowered to a position in which the mast 14 is between the wheel arms 18 it is necessary for the side shift 20 to be in its middle position.

The side shift 20 has associated therewith an analog sensor which is not shown in FIG. 2. It is designated 30 in FIG. 3. The analog sensor 30 generates an analog position signal in response to the position of the slider 20 relative to a middle line 32 (FIG. 2) which indicates the middle position of the slider 20. A signal of the sensor 30 is sent to a display 32 in the cabin of the fork-lift reach truck to make the driver know in which position the side shift 20 is. The position signal of the analog sensor 30 is also sent to a control and regulation device 34 as is commonly used in fork-lift reach trucks for the lifting and lowering or displacing modes of the mast and the lifting and lowering of the load-carrying means. The device 34 additionally is capable of processing the position signal of the sensor 30. 36 designates an operating member in the cabin of the fork-lift truck which, when actuated, causes a displacement of the side shift 20. The operating member 36 helps a movement to any position of the side shift 20 in response to its excursion. This is accomplished via the control and regulation device 34 which, in turn, sends a signal to a control 30 to actuate the displacing cylinder 26. Additionally or alternatively, an operating member 40 can be provided, e.g. a switching button which, when actuated, causes the control and regulation device 34 to automatically move to the middle position of the side shift 20.

Figure 3:
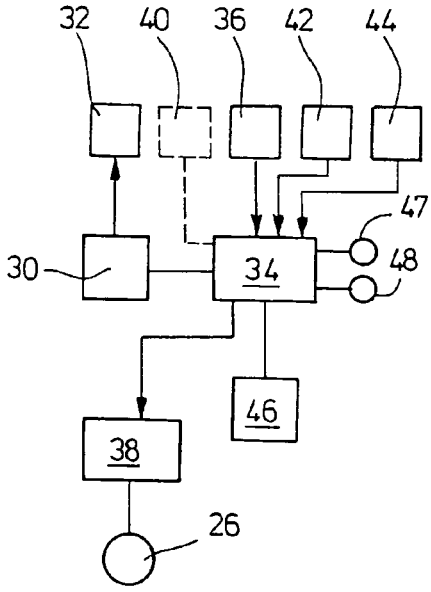
FIG. 3 shows a block diagram for the operation of components of the fork-lift reach truck of FIG. 1.

FIG. 3 also outlines the operating members 42 and 44 for the mast advancement and the lifting and lowering of the load-carrying means. They are also in communication with the control and regulation device 34. The respective drives are designated 47 and 48. Now, when the mast 14 is desired to be retracted or the load-carrying means 16 to be lowered by actuating the operating members 42 or 44 the control and regulation device 34 finds out whether the side shift 20 has taken its middle position. This is accomplished by retrieving the signal of the sensor 30. When a position out of the middle is found the mast 14 is blocked from being retracted and the load-carrying means 16 from being lowered until the side shift 20 has automatically been moved to the middle position via the drive 26.

An onboard computer 56, which also forms part of the fork-lift reach truck of FIG. 1, calculates the maximum travel speed for the travel motor, which is not shown, in accordance with stability criteria. Known stability criteria, for example, are the weight of the load on the load-carrying means, the height of the load-carrying means, the inclination of the mast, etc. Furthermore, the position of the side shift 20 can be a stability criterion which is also entered in the onboard computer 46 for being incorporated into a calculation of the maximum travel speed.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. A fork-lift reach truck having an extraction mast which is adapted to be displaced, by means of a mast drive, towards and away from a driving portion of the fork-lift truck on a horizontal guide, a load-carrying means which is mounted on a side shift, a side shift guide which is supported by the extraction mast in a height-adjustable way and is adapted to be actuated by means of a lifting and lowering drive, which guides the side shift in a laterally movable way, and a side shift drive, and an electric control and regulation device for the respective drives which is connected to operating members for the lifting and lowering modes, the mast extraction mode, and the side shift mode, characterized in that an analog sensor (30) detecting the position of the side shift (20) is provided the position signal of which is sent to the control and regulation device (34), and that the control and regulation device (34) is connected to a separate operating member for the side shift (20) or the operating member for the side shift is configured in such a way that actuating it causes the side shift (20) to be automatically moved to a predetermined position, preferably a middle position.

2. The fork-lift reach truck as claimed in claim 1, characterized in that the operating member (36) for the side shift (20) is configured as a set point transmitter which, in response to its displacement path or angle, generates a set point signal for the control and regulation device (34).

3. The fork-lift reach truck as claimed in claim 1, characterized in that the control and regulation device (34) sends a signal to the side shift drive (26) to move to the predetermined position when a signal for a retraction of the mast (12) is generated by the operating member (42) for the mast extraction and/or a signal for the lowering of the load-carrying means (16) is generated by the operating member (44) for the lifting and lowering modes.

4. The fork-lift truck as claimed in claim 1, characterized in that the control and regulation device (34) is connected to an onboard computer (46) and/or forms part thereof, the onboard computer (34) limits the traveling and/or cornering speed of the fork-lift truck in conformity with stability criteria and the position signal of the sensor (30) is sent to the onboard computer (46) for a modification of the traveling speed of the fork-lift truck in dependence on the position of the side shift (20).

* * * * *